US007390557B2

(12) United States Patent
Hämäläinen et al.

(10) Patent No.: US 7,390,557 B2
(45) Date of Patent: Jun. 24, 2008

(54) METHOD FOR COATING A WEB OF PAPER OR PAPERBOARD AND A COATED PAPER GRADE

(75) Inventors: Markku Hämäläinen, Siltakylä (FI); Vilho Nissinen, Numminen (FI)

(73) Assignee: Metso Paper, Inc., Helsinki (FI)

( * ) Notice: Subject to any disclaimer, the term of this patent is extended or adjusted under 35 U.S.C. 154(b) by 443 days.

(21) Appl. No.: 10/471,628

(22) PCT Filed: Mar. 13, 2002

(86) PCT No.: PCT/FI02/00202

§ 371 (c)(1),
(2), (4) Date: Sep. 12, 2003

(87) PCT Pub. No.: WO02/072952

PCT Pub. Date: Sep. 19, 2002

(65) Prior Publication Data

US 2004/0131875 A1 Jul. 8, 2004

(30) Foreign Application Priority Data

Mar. 13, 2001 (FI) ..... 20010503

(51) Int. Cl.
*B32B 3/00* (2006.01)

(52) U.S. Cl. ..... 428/211; 428/332; 428/334; 428/337; 428/537.5; 162/135; 162/136; 162/137; 162/147; 162/205; 162/265; 427/317; 427/324; 427/325; 427/326

(58) Field of Classification Search ..... 428/211, 428/334, 332, 337, 537.5; 162/135, 136, 162/137, 147, 205, 265; 427/317, 324, 325, 427/326

See application file for complete search history.

(56) References Cited

U.S. PATENT DOCUMENTS

| | | | | |
|---|---|---|---|---|
| 6,063,449 | A | 5/2000 | Koskinen et al. | |
| 6,106,902 | A | 8/2000 | Koskinen et al. | |
| 6,237,525 | B1 | 5/2001 | Kinnunen | |
| 6,589,288 | B2 * | 7/2003 | McDowell et al. | 623/33 |
| 6,787,196 | B2 * | 9/2004 | Nissinen et al. | 427/458 |
| 2001/0009700 | A1 | 7/2001 | Ilmasti et al. | |
| 2001/0048976 | A1 | 12/2001 | Hess | |

FOREIGN PATENT DOCUMENTS

| | | |
|---|---|---|
| EP | 1 040 225 | 4/1999 |
| WO | WO 9506522 A1 | 3/1995 |
| WO | WO 99/15731 | 4/1999 |
| WO | WO 9919081 A1 | 4/1999 |

* cited by examiner

*Primary Examiner*—Leszek Kiliman
(74) *Attorney, Agent, or Firm*—Cohen Pontani Lieberman & Pavane LLP

(57) ABSTRACT

A method for manufacturing a web of paper and paperboard, in which method a spray-coating technique is used for applying a web treatment substance to at least one surface of a moving web. The qualities of the web treatment substance are selected such that at least the droplet size and viscosity of the web treatment substance are controlled such as to make the thickness of the applied web treatment substance essentially equal in at least two randomly selected sample areas. According to the invention, the applied coating conforms with the surface contour of the base sheet. A paper manufactured using the method.

28 Claims, 3 Drawing Sheets

Contact angle in solid- air- liquid- interface

$$\cos\theta = \frac{\gamma_{SA} - \gamma_{SL}}{\gamma_{LA}}$$

- in which $\theta$ contact angle
- $\gamma_{SA}$ interfacial energy of solid/air surface
- $\gamma_{SL}$ interfacial energy of solid/liquid surface
- $\gamma_{LA}$ interfacial energy of liquid/air surface

METHOD FOR COATING A WEB OF PAPER OR PAPERBOARD AND A COATED PAPER GRADE

PRIORITY CLAIM

This is a national stage of PCT application No. PCT/FI02/00202, filed on Mar. 13, 2002. Priority is claimed on that application and on Application No. 20010503, filed on Mar. 13, 2001 in Finland.

BACKGROUND OF THE INVENTION

1. Field of the Invention.

The invention relates to a method for manufacturing a web of paper or paperboard using a spray-coating technique wherein the web treatment substance such as a coating is applied to the surface of a moving web by means of spraying the substance from high-pressure spray nozzles onto the web.

The invention also relates to a paper grade manufactured using the method.

2. Description of the Related Art.

Currently, application of coating to a web of paper and paperboard is carried out using a plurality of different methods. Each application method has certain characteristic features that affect the quality of the finished product and its manufacturing process. In regard to the optimal production process, the choice must be made based on the actual running speed and strength of the web. The qualities to be rendered to the finished product are determined by the end use of the product, which in practice is defined by the printing method applied to the product and the intended degree of quality to be rendered to the final printed surface. In general, good printability can be achieved by giving the web a sufficiently smooth and even surface having an extremely high brightness. These qualities can be attained by applying a sufficient number of coating layers to the web being processed and then calendering the same in the different phases of paper manufacture. Obviously, as a high number of treatment steps increase the end price of the product, it must be understood that the choice of the proper manufacturing technique is ultimately dictated by the qualities that are desired from the end product. After the suitable process for the desired end product is chosen, it is possible to select such a finishing technique that renders the optimum result in terms of production efficiency and end product quality.

One promising application method is the spray-coating technique, wherein the coating finish or other web treatment material is applied to the surface of a paper or paperboard web by means of high-pressure spray nozzles. In this method, the web treatment material is pressurized to a high pressure and then sprayed from a small-orifice spray nozzle at a high velocity onto the web. A benefit of the method is that it imposes minimal stress on the web resulting in a good runnability behavior of the spray-coating apparatuses. As it is implemented in a fully noncontacting fashion, this kind of application excels over conventional blade and film-transfer techniques by being more gentle and less stressing to the web thus facilitating a production efficiency increase of about 5% as compared with blade application. In a different point of view, this allows the web to be produced from a stock of weaker strength, which is a particular benefit in making paper from recycle fiber. Contacting application methods such as blade coating or film-transfer coating always need between the web surface and the excess-coating-doctoring element a gap that determines the thickness of the applied coat. Due to this and other factors, the final coat weight is affected by quality variations in the base sheet, among other things by its profile deviations and surface roughness. In contrast, a spray-coater applies to the web under all circumstances a coating layer of constant weight entirely unaffected by base sheet quality variations. Moreover, spray-coating can be performed to a base sheet whose moisture content is higher and, hence, whose strength is lower than what has been acceptable earlier.

The price and quantity of raw materials used in papermaking have a crucial impact on the competitiveness of paper grades produced. Herein, spray-coating allows the production of the base sheet from a cheaper stock of lower strength without essentially compromising the end product quality. Inasmuch this coating method is free from streaking that typically is a handicap of other methods by occurring during coat smoothing and metering, it also permits the use of filler-grade calcium carbonate that is cheaper than coating-grade calcium carbonate. In the spray-coating method, the penetration of web treatment substance into the base web is minimal thus leaving the pigment or size particles onto the web surface. Resultingly, web porosity can be reduced by surface sizing resulting in reduced penetration of coating agent into the web, whereby the covering effect of surface size increases.

Hence, spray-coating method can be used for producing novel grades of paper.

SUMMARY OF THE INVENTION

It is an object of the present invention to provide a method suited for manufacturing paper or paperboard of improved printing qualities in such a manner that while the printing qualities of the produced grade are made essentially different from those of an uncoated grade, the manufacturing costs will not differ substantially from those of an uncoated grade.

The goal of the invention is achieved by way of spray-coating the surface of the moving web with a coating layer wherein the coating layer thickness in two randomly chosen samples of coated web area is essentially equal when the sample area is selected such that the smallest dimension across the area is at least twice the thickness of fiber in the base sheet.

Furthermore, in each one of the randomly selected web area samples the pore size of the coating layer surface is made such that the pores permit penetration of oil used as a carrier in the printing ink but do not pass the pigment particles of the ink. In other words, the pore size of the coated surface can maximally be equal to the size of the pigment particles but the coating may not fully seal the surface of the base sheet.

More specifically, the method according to the invention involves controlling the droplets size and viscosity of the web treatment substance to achieve the desired properties of the coating layer.

The invention offers significant benefits.

The invention makes it possible to extend the use of coatings in paper grades whose market price has not previously permitted the extra cost imparted by coating. Accordingly, it is now possible to produce, e.g., such newsprint whose characteristics facilitate color printing at an improved quality level without an essential cost increase in the printing paper. Using the spray-coating method, it is possible to vary the coat weight in a wide range from a few grams per square meter to as heavy coats are required. Owing to these benefits, the scope of coating techniques can be extended toward coat weights heavier than those feasible in the prior art. However, a specific benefit of the spray-coating technique has been found therein that controlled application now becomes possible also for coatings so lightweight that they have been impossible or at least extremely complicated to achieve by means of conventional coating techniques. Spray-coating can provide a substantial brightness increase even at very low coat weights. E.g., coated newsprint grades of a coat weight as low as 4 to 6 g/m$^2$ have exhibited a printing quality finer than that achievable by conventional newsprint grades and yet using about 20% less ink.

The porosity of the coat surface structure can be controlled by varying the size of the spray nozzle orifice, spraying pressure and, in particular, the qualities of the web treatment substance. Since the web treatment substance is transferred onto the web surface in droplet form, the pore structure of the web surface is determined by the size and number of sprayed droplets and the spreading of the droplets on the web surface. Hence, the spray-coating method is capable of controlling the porosity of the web surface in a fashion not offered by other application techniques. It is a characteristic feature of this application technique that the coat weight becomes uniform over the entire area of the web irrespective of deviations in the web profile, thus making it possible to apply an equal amount of coating on both the valleys and the crests of the profile. By the same token, the pore structure of the coated surface is homogeneous and not dependent on the structure and profile of the base sheet. Owing to the minimal stress imposed on the web by the spray-coating technique, application can be performed on a low-strength base sheet, whereby the web may have a high moisture content or contain great amounts of low-grade fiber of reduced strength qualities. Since spray-coating does not force the coating pigment particles into the interior structure of the base sheet fiber matrix, the consumption of coating furnish is smaller.

Spray-coating can be performed in any type of paper or paperboard machine, even on an extremely moist web. Hence, the applicator units can be located on the press or dryer sections of the machine, whereby the length dimension of the machine will not become substantially longer. When the amount of web treatment substance applied is small, the existing drying capacity of the paper machine may be sufficient for drying the applied coating or size, while larger amounts of coating may need extra drying capacity. Then, the machine must be complemented with noncontacting dryers or dryer cylinders. Owing to these benefits, spray-coating as compared with conventional coating methods is easier to implement and involves lower investment costs. The method is also well suited for improving the degree of finishing produced by existing equipment. In a broad sense, a spray-coating system is characterized by a sufficiently good quality of applied coat, a wide range of applicable coat weights, suitability for use at high web speeds and nonpenetrating adherence of coating pigment particles to the web surface due to the low impact force of a short duration.

The qualities of spray-coated paper are different from those of paper grades manufactured using conventional coating methods. In spray-coating, the final moisture content can be left higher than in conventional methods, that is, as high as 7 to 9%. Resultingly, a reduced dryer capacity will suffice. The applied coat has a lower blistering-tendency allowing the product to be used in printing methods that impose a stress on the sheet surface. Furthermore, the combination of sheet brightness and opacity is improved so that, e.g., at about 76% ISO brightness, the opacity is increased by more than 2%. The amount of chemical pulp fiber can be reduced from the conventional level of 30 to 40% in paper grades made from mechanical pulp furnish as low as to 10 to 20%. Nevertheless, the sheet stiffness is improved even more than 25% over that of a conventionally coated paper of equivalent grade. The new paper grades are suited for use in both the CSWO (cold-set web offset) and HSWO (heat-set web offset) printing systems. Additionally, the new paper grade allows a temperature reduction as much as 30% in the drying oven of a HSWO system. On the other hand, the tailored porosity of the new paper grade assures fast setting of printing ink in a CSWO system thus giving a good printing result. Obviously, the method may also be utilized to produce paper or paperboard grades optimized for other printing systems.

Since the spray-coating technique differs from other application methods by imposing a low stress on the base sheet, it is capable of rendering a coated paper grade of a reduced amount of raised fibers, more pleasing surface handle and good uniformity of print. Improved brightness and opacity result from the uniform coat and also the sheet stiffness increases.

BRIEF DESCRIPTION OF THE DRAWINGS

In the following, the invention will be examined in greater detail with the help of exemplifying embodiments and making reference to the appended drawings in which.

DETAILED DESCRIPTION OF THE PRESENTLY PREFERRED EMBODIMENTS

In the text below describing embodiments of the invention, the term spray-coater is used for making reference to an apparatus suited for applying treating agent to the surface of a web from a plurality of spray nozzles adapted over the cross-machine width of the web by way of spraying a web treatment agent under pressure via the nozzles onto the web. The nozzles may be located in plural rows that are advantageously adapted into a hood serving to prevent at least a major portion of the coating mixture mist from escaping to the surroundings. Spray-coating methods and apparatuses are described in the applicant's parallel patents U.S. Pat. No. 6,106,902 and U.S. Pat. No. 6,063,449, which are included herein by reference.

Figure 1:
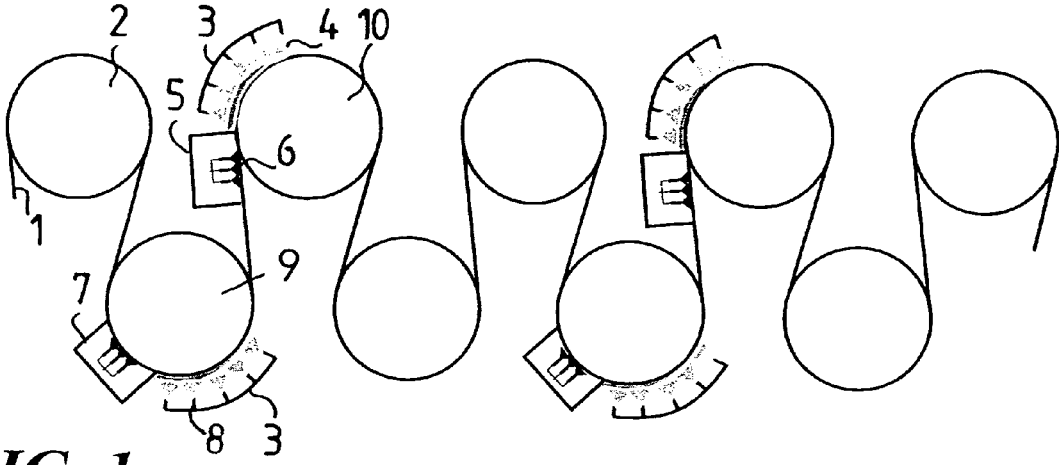
FIG. 1 shows a diagrammatic view of a first embodiment of the invention.

In the configuration of FIG. 1, spray-coating is arranged to take place at a dryer cylinder group, wherein a web 1 passes over cylinders 2 so that the side facing a dryer cylinder 2 changes in an alternating fashion. The arrangement shown in FIG. 1 may be considered to illustrate a portion of a dryer cylinder group or even the entire group. In principle, the arrangement can be implemented by locating the applicator units at any point of the cylinder group assembly. Obviously, the number of cylinders needed herein is dependent on the required drying capacity. In this diagram, the web 1 is passed onto the first cylinder 2, and a spray-coater unit 7 is adapted to operate in conjunction with the next cylinder 9. The coater unit 7 comprises a hood 5 with spray nozzles 6 located therein. Application takes place by feeding a web treatment substance at a high pressure, e.g., about 80 to 180 bar, into spray nozzles 6, whereby the treatment agent at exit from a nozzle of a small diameter of about 0.25 to 0.4 mm attains a velocity of about 100 m/s, is atomized into droplets and spreads as a fan-shaped spray of a given opening angle. The atomized coating mist hits the surface of the passing web. Nozzles may be placed over the cross-machine width of the web at 50 to 70 mm distance between each other into a single linear array or plural arrays, and the distance of the nozzles from the web is typically 10 to 100 mm.

Operating in conjunction with the coater unit 7 on the same cylinder 9 is adapted an ion-blast unit 3 comprising a plurality of pointed electrodes 8. A high-voltage field can be applied between the electrodes 8 and the cylinder 9, whereby the stream of ionized gas molecules leaving the electrode tips also ionizes the coating mist 4 possibly trying to escape from the hood 5 and then, with the help of the electric field, directs the mist to adhere to the surface of the web 1. This device serving to capture the stray coating mist may be constructed integral with the coater unit or, alternatively, be a separate device. Advantageously, however, the mist control device is located as close as possible to the coater unit 7. A coating mist control method and device is described in the applicant's European patent application EP 1 040 225.

Immediately after leaving the second cylinder 9, the web 1 passes to the next cylinder 10, whereby the outside of the web not facing the cylinder is reversed. This cylinder incorporates similar coater and coating mix control means as those described above for treating the other side of the web. After the second application phase, the web 1 passes over two dryer cylinders to the next application phase, wherein application takes place in the same fashion as in the first application phase. This embodiment is characterized in that a noncontacting dryer is not used for drying the coated side of the web after application, which means that the weight and quality of the applied coat must be selected such that the coating will dry and set sufficiently before the treated side of the web meets the dryer cylinder. Accordingly, this configuration is best suited for applying lightweight coats. It must be further noted that although application herein takes place in two phases, the process is not a genuine two-layer application, but rather, the application is carried out in two phases in order to provide sufficient drying of the web after application, whereby a smoother coat profile both in the machine and cross-machine directions is attained using plural application phases. However, with the provision that a sufficiently high drying capacity is available, the number of applications can be increased so as to make a two-layer coating, whereby different kinds of coating mixtures can be used in the successive applications. For instance, the first application can be made using surface size instead of coating.

Figure 2:
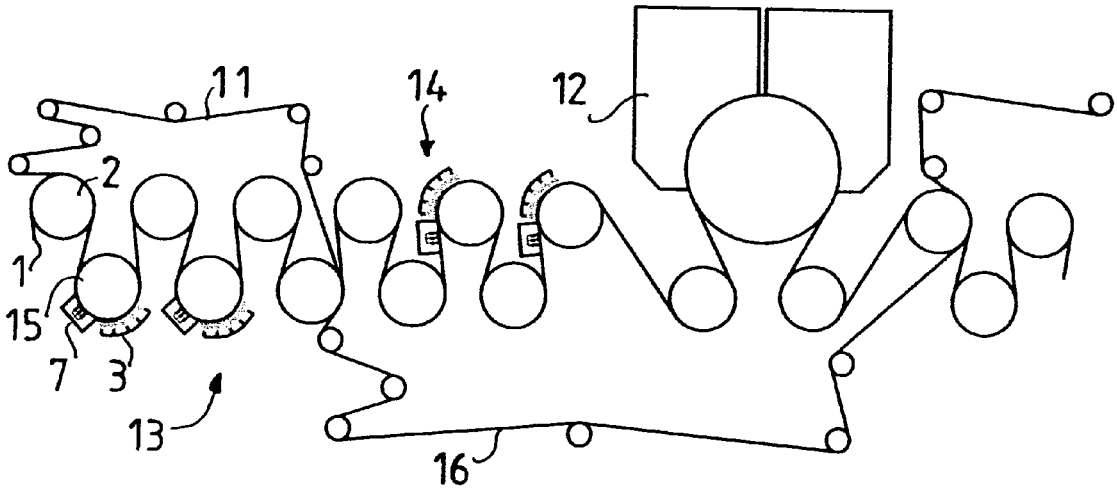
FIG. 2 shows a diagrammatic view of a second embodiment of the invention.

In the configuration of FIG. 2, the spray-coating units 7, 3 are adapted to operate in conjunction with single-wire-supported dryer cylinder groups 13, 14. This kind of dryer cylinder group is comprised of an alternating sequence of heated rolls 2 and suction rolls 15, whereby the web 1 is guided to pass through the cylinder group supported by wire 11 so that on the heated rolls the web 1 passes over the roll while on the suction rolls the wire 11 passes over the roll. The spray-coater units 7, 3 are located to operate in conjunction with suction rolls 15. An advantage of this configuration is that the web runs continuously supported. Spray-coating is herein carried out using two successive application phases on the same side of the web within a single dryer cylinder group.

From the first dryer cylinder group 13 the web is passed to a second cylinder group 14 of similar construction, whereby the web is transferred from support wire 11 to support wire 16. Within the latter cylinder group 14, application is carried out again twice on the same side of the web. Next to the application point in the second dryer cylinder group 14 is adapted an impingement air dryer 12 comprising a suction roll with impingement air hoods. The web 1 is passed in the impingement air dryer 12 supported by the same wire as that running through the dryer cylinder group 14. Also in this configuration, the web treatment substance must set rapidly on the web surface notwithstanding the substantially higher drying capacity provided by the impingement air unit.

Figure 3:
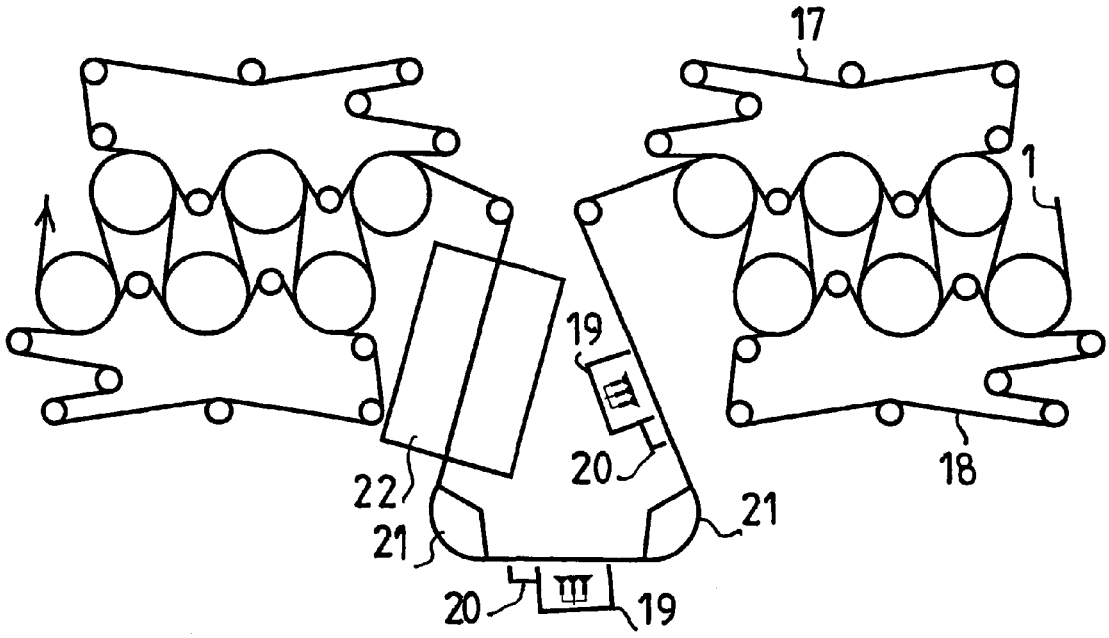
FIG. 3 shows a diagrammatic view of a third embodiment of the invention.

The configuration of FIG. 3 is intended for use on the dryer section of a papermaking machine. In this embodiment, two-wire web support is used at the dryer cylinders so that both sides of the cylinder group are wrapped by separate wires 17, 18 serving to press the web against the dryer cylinders. The web 1 is passed unsupportedly from one cylinder to the next. From the first dryer cylinder group, the web is passed downward to a first spray-coating unit 19. The downward-deflected path of the web is advantageous inasmuch it prevents coating mix drops possibly formed in the coater unit from landing on the web being coated. Stray coating mist formed in the coater unit 19 is removed by vacuum into a suction box 20 located at either the outgoing end of the coater unit or immediately thereafter. At this stage, the travel of web 1 after application is guided with the help of air deflection means 21, thus making it possible to apply such coating formulations that are sticky when unset. Web guidance can be arranged with rolls in the case that the coating mix used is not sticky. In the next step, the other side of the web is coated using a spray-coater unit 19 that also is located below the web 1 in order to avoid coating mix drops from landing on the web. Also from this applicator the web 1 is passed forward guided by air deflection means. Next, the web 1 is passed to a noncontacting dryer 22, wherein the web is dried to a nonsticky moisture content for the following dryer cylinder group. The noncontacting dryer may be an airborne dryer, radiant infrared dryer or some other conventional noncontacting dryer. Obviously, the required drying capacity is dependent on the coat weight applied, as well as on the type of coating mix and the moisture content of the base sheet.

Figure 4:
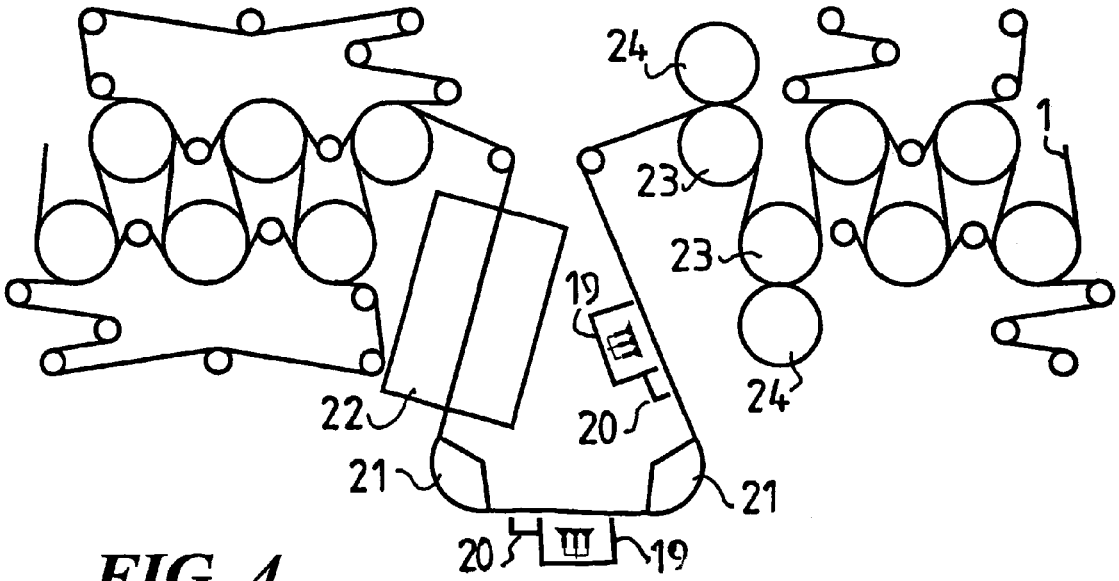
FIG. 4 shows a diagrammatic view of a fourth embodiment of the invention.

The configuration of FIG. 4 is similar to that described above with the exception that there is adapted after the first dryer cylinder group a calender nip formed by rolls 23, 24 for smoothing the sheet surface. The rolls may be covered or uncovered rolls, heated or unheated rolls as considered appropriate. Also a plural number of calender nips can be used and they may be located at any point within the confines of the available space and web moisture content.

Figure 5:
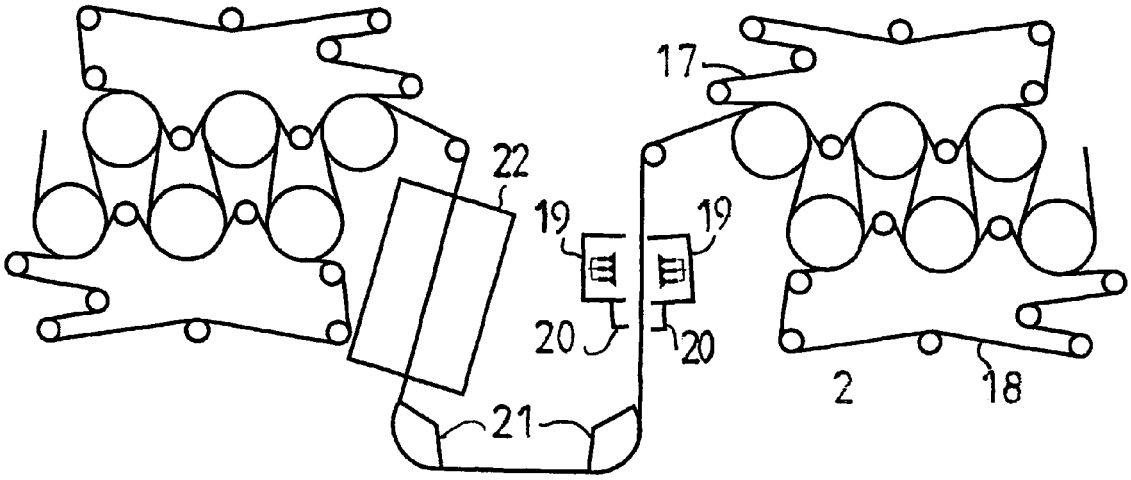
FIG. 5 shows a diagrammatic view of a fifth embodiment of the invention.

The configuration of FIG. 5 is suited for simultaneous two-sided coating of paper. The web 1 is passed to the coater with the help of a two-wire draw 17, 18. After passing through the dryer cylinder group, the web is guided to run vertically so as to travel via the gap formed by two spray-coating units 19. The web is advantageously arranged to run vertically, whereby the coater unit is not located directly above the web in which position it could permit coating mist condensing in the coater to drop onto the web. When landing onto the web, such large drops may cause defects on the coated surface. The spray-coater units 19 can be similar to those described in the other exemplary constructions. As both sides of the web are wet when leaving the coater unit, the web must be guided by noncontacting deflection means until the web surface dries sufficiently to attain a nonsticky state. In the embodiment of FIG. 5, the web is first guided to run horizontally and then deflected by air deflection means 21, to run upward. In this fashion, the web 1 is guided by the air deflection means, 21 to enter a noncontacting dryer 22. Accordingly, the construction of FIG. 5 is similar to those of FIGS. 3 and 4 described above as to the arrangement of coating application and dryer groups.

The only difference can be seen in the guidance of the web directly downward and the opposed location of both coater units.

It is an essential requirement in spray-coating that to the surface of a paper or paperboard web is applied a uniform coating wherein the thickness of the coating layer is preferably homogeneous over the entire area of a microstructure surface sample of the coated web, that is, within an area smaller than that representing macroscopic changes in the web profile in the machine and cross-machine directions. Herein, the fiber thickness may be taken as the smallest characterizing dimension of such an area, which means that smallest dimension of the web surface area examined must be the fiber thickness multiplied by at least two, preferably by a plural number. Within such a sample area, the coating should conform with the base sheet contour so accurately that the contour of the base sheet is reflected on the coated web surface. Advantageously, the dimension of the sample area used in coat measurements is set to be 2 to 50 times the average thickness of fibers in the base sheet to be coated and the difference between average coating layer thicknesses in two pore-free sample areas should be smaller than half the average fiber thickness. Another characterizing property of the spray-coating method over conventional application techniques is that it minimizes the thickness variations of a coat layer applied to the web surface. In spray-coating, coat thickness variation falls within ±50% of the nominal coat weight. The thickness distribution may be measured using, e.g., a laser-induced plasmaspectrometer. Hence, spray-coating is capable of applying a coat that has a substantially smaller number of areas in which the coat weight is appreciably higher or lower than the nominal coat weight. This feature is highly advantageous in order to control web roughness due to sticking fibers and to achieve uniform printability as well as high opacity and brightness, all of these factors contributing to high quality of a printed product.

In test sheets made from a calendered HSWO paper grade, the average pore size has been within 0.045-0.050 μm. Herein, the pore size of the coated surface should be made compatible with the printing ink to be used. To achieve fast setting of the printing ink on the printing substrate, the goal is to allow fast absorption of the printing ink solvents into the base sheet while setting the color pigment particles as rapidly as possible on the coated surface of the web. These objects can be met by adjusting the coater and selecting a proper web treatment agent. Another factor of great significance to the absorption capability of the web is calendering as to the method and intensity thereof. Calendering is particularly important for papers used in HSWO printing, whereby the calendering of these paper grades must be sufficiently effective in conjunction with spray-coating to keep printing ink consumption reasonably low during printing. Essential factors controlling the application of the coating mixture onto the web surface are the droplet diameter of the coating mist and the wetting capability of the droplets, that is, the ability thereof to extend on the web surface. The droplet size of the mist formed from the furnish of a given wet treatment substance can be controlled by varying the orifice size and design of the spray nozzle and the infeed pressure. The most important parameter controlling the spraying process is the coating mix viscosity. In addition to modifying the droplet size distribution, viscosity affects the flow of coating mix through the nozzle and the spray pattern. At a high viscosity, the Reynolds number is decreased and the generation of turbulence, fanning of the spray and formation of droplets becomes more complicated to control, whereby the droplet size increases.

Figure 6:
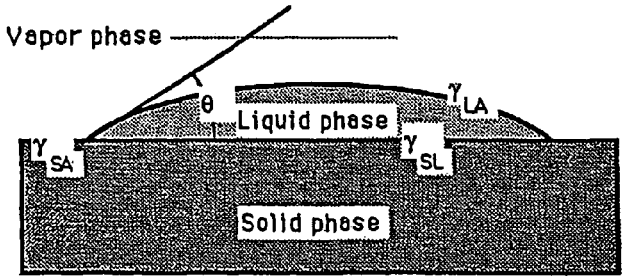
FIG. 6 shows the spreading of a droplet onto a surface being treated.

When generated by means of high-pressure nozzle, a major portion of droplets formed from a coating mixture have been found to be 20 to 60 μm in diameter. Since this droplet size is larger than the coat thickness typically applied, the spreading behavior of the droplet when falling onto the web surface is a significant factor contributing to the outcome of coating. When the liquid phase of the droplet assumes an equilibrium state with the other phases contacting the droplet, the contact angle formed by the fluid droplet is proportional to the free energy between the phases. Hence, the wetting power of the droplet is characterized by the contact angle between the web and the droplet landing thereon as defined in FIG. 6. The value of the contact angle is determined by the mutual energy between the different phases, whereby three phase pairs interact with each other on a solid-state substrate. The contact angle can be computed from the formula:

$$\cos\theta = \frac{\gamma_{SA} - \gamma_{SL}}{\gamma_{LA}}$$

where $\theta$=contact angle $\gamma_{SA}$=difference of free energy at the solid/gas phase interface $\gamma_{SL}$=difference of free energy at the solid/liquid phase interface $\gamma_{LA}$=difference of free energy at the liquid/gas phase interface.

A small contact angle means that the web treatment substance spreads readily on the web surface. In practice, the contact angle should be smaller than 90°, and the major factor affecting the contact angle is the viscosity of the droplet fluid that should advantageously be equal to or even less than 100 mPas, Brookfield 100, while it is possible to use web treatment agents having a viscosity up to 150 niPas. The second contributing factor is the surface tension of the aqueous phase and the third factor is the behavior of the droplet at the interface defined by the base sheet, surrounding air and the web treatment substance. Surface tension can be lowered by means of suitable additives and also the rejection force between the droplet and the web surface may be reduced. Obviously, the behavior of the droplet on the web surface is further dependent on whether the web itself is possibly treated with additives and what kind of fiber has been used in making the web.

In practice, the spreading of a droplet on the surface of a substrate such as a porous sheet of paper or paperboard is determined by the adhesion forces between the substrate surface and the coating mixture droplet. If the adhesion between the substrate surface and the coating mixture droplet exceeds the internal cohesion force of the droplet, the adhesion force will cause the droplet to spread on the substrate surface. If this condition is not met, external energy must be provided to spread the droplet. When examined as a whole, the spray-coating process must impart sufficient energy to convert a fluid into droplets, move the droplets onto the surface to be treated and finally cause the droplets to spread on the surface. Hence, a uniform coating can be attained by ensuring a sufficiently low viscosity of the coating mixture, a sufficiently low surface tension of the aqueous phase, a high impact velocity of coating droplets, a small contact angle of the coating droplet and a high surface energy of the paper web.

Utilizing the spray-coating technique in the above-described fashion it is possible to manufacture in an advantageous fashion the following kind of paper that can be used for concurrent needs of newsprint, but whose printability properties are improved over uncoated newsprint and are compatible with most ones of printing methods, particularly the CSWO printing method as well as the HSWO printing method, too. To keep the price of the paper reasonably low, its basis weight should be lightweight, that is, less than 45 g/m$^2$, advantageously 30 to 40 g/m$^2$. Also the coat weight on one side of the base sheet should be small, typically less than 7 g/m$^2$, advantageous 4 to 6 g/m$^2$. However, in paper grades optimized for the CSWO printing method, the coat weight should be at least 8 g/m$^2$ on either side of the base sheet, while paper grades suited for the HSWO printing methods should have a coat weight of at least 9 g/m$^2$. In these printing methods, the print quality becomes substantially inferior at coat weighs smaller than these guideline values. Advantageously, carbonate-based coatings can be used for application. The most important feature of the new paper grade is the contour of its surface profile that conforms very accurately with the base sheet profile, thus allowing surface qualities of the finished end product to be affected strongly, e.g., by calendering the web before application. The optimal conformity with base paper contour can be attained by suitable control of droplet size in the coating mixture spray and of other coating mixture properties, particularly the viscosity and aqueous-phase surface tension thereof.

In addition to those described above, the present invention may have alternative embodiments.

While the application system described in the foregoing can be implemented most advantageously on the dryer section of a paper or paperboard machine, spray-coating is also possible as early as on the press section. Alternatively, spray-coating may be performed after the dryer section or using an off-machine coater section, but this arrangement needs separate dryers and, hence, more footprint to accommodate the coater section. While coating is preferably applied in several phases, even a single-phase application can render a good end result, particularly if a plurality of spray nozzles mounted in staggered linear arrays are used in the single coater. If so desired, also unsymmetrical two-sided application is possible, whereby different qualities can be given the sides of the web.

Since the application stress on the web is minimal in the spray-coating method, it is a characterizing property thereof that application can be performed either on a web supported by a backing member such as a roll, wire or belt, or, alternatively on a web running unsupported over an open draw. If the surface of the web does not have enough time to dry sufficiently nonsticky to receive a treatment of the web surface, e.g., on a backing roll, supplementary drying of the web surface must be arranged using a noncontacting dryer such as an airborne dryer or a radiant infrared dryer.

What is claimed is:

1. A method for manufacturing a coated web of paper or paperboard, comprising the step of:

applying droplets of a web treatment substance to at least one surface of a moving web of paper or paperboard by spray-coating to form a web treatment substance layer thereon, wherein the web treatment substance comprises coating pigment particles, and wherein at least droplet size and viscosity of the web treatment substance are controlled to achieve an optimal spreading behavior of the droplets on the at least one surface of the moving web of paper or paperboard such that thicknesses of the web treatment substance layer in two randomly chosen sample areas of the spray-coated at least one surface of the web are essentially equal when each of the sample areas is selected such that a smallest dimension across said each of the sample areas is at least twice the thickness of fiber in the web, whereby the web treatment substance layer has a surface contour which conforms with a surface contour of the at least one surface of the web.

2. The method of claim 1, wherein the web treatment substance droplet size and viscosity are controlled so that, in said each of the sample areas, the web treatment substance layer has pores which are sized to permit penetration of oil used as a carrier in a printing ink but not to pass pigment particles of the printing ink.

3. The method of claim 1, wherein the web treatment substance droplet size and viscosity are controlled so that the amount of applied web treatment substance falls within ±50% of a nominal amount to be applied.

4. The method of claim 1, wherein the spray-coating step is performed by a spray-coater which operates as an integral unit within a paper or paperboard machine.

5. The method of claim 1, wherein the spray-coating step takes place on a dryer section of a paper or paperboard machine.

6. The method of claim 5, wherein, prior to application of the web treatment substance, the web is calendered by a calender adapted to operate on the dryer section of the paper or paperboard machine.

7. The method of claim 1, wherein the web is calendered after application of the web treatment substance.

8. The method of claim 1, wherein, in the spray-coating step, the web is supported by a wire, belt or roll.

9. The method of claim 1, wherein, in the spray-coating step, the web running is unsupported over an open draw.

10. The method of claim 1, wherein the web is dried by at least one noncontacting dryer after at least one web treatment substance application phase.

11. The method of claim 10, wherein the web is guided by at least one air-deflection means after at least one web treatment substance application phase.

12. The method of claim 1, wherein the web treatment substance to be applied has a viscosity of not greater than 150 mPas.

13. The method of claim 1, wherein the web treatment substance is applied at a contact angle of not greater than 90° relative to the surface of the web being spray-coated.

14. The method of claim 1, wherein the web treatment substance further comprises an agent acting as a surfactant in an aqueous phase.

15. The method of claim 1, wherein, after application of the web treatment substance, the spray-coated at least one surface of the web is dried by a noncontacting dryer.

16. A printing paper comprising:

a base sheet; and a web treatment substance layer on at least one side of the base sheet, the web treatment substance layer comprising coating pigment particles, wherein the web treatment substance layer is formed by applying droplets of a web treatment substance comprising coating pigment articles on the at least one side of the base sheet by spray-coating, at least droplet size and viscosity of the web treatment substance being controlled to achieve an optimal spreading behavior of the droplets on the at least one side of the base sheet such that thicknesses of the web treatment substance layer in two randomly chosen sample areas of the spray-coated at least one side of the base sheet are essentially equal when each of the sample areas is selected such that the smallest dimension across said each of the sample areas is at least twice the thickness of fiber in the base sheet, whereby the web treatment substance layer has a surface contour which confirms with a surface contour of the at least one side of the base sheet.

17. The printing paper of claim 16, wherein, in said each of the sample areas, the web treatment substance layer has pores which are sized to permit penetration of oil acting as a carrier in a printing ink but not to pass pigment particles of the printing ink.

18. The printing paper of claim 16, wherein, in said each of the sample areas, the amount of applied web treatment substance falls within ±50% of a nominal amount to be applied.

19. The printing paper of claim 16, wherein the web treatment substance layer has a weight of not greater than 7 $g/m^2$.

20. The printing paper of claim 16, intended for use in CSWO or HSWO printing method, wherein the web treatment substance layer has a weight of at least 8 $g/m^2$.

21. The printing paper of claim 16, wherein the base sheet has a weight of 30 to 45 $g/m^2$.

22. The printing paper of claim 16, wherein the coating pigment particles are carbonate-based.

23. The printing paper of claim 16, wherein the web treatment substance to be applied has a viscosity of not greater than 150 mPas.

24. The printing paper of claim 16, wherein the web treatment substance is applied at a contact angle of not greater than 90° relative to the side of the base sheet being spray-coated.

25. The printing paper of claim 19, wherein the web treatment substance layer has a weight of between 4 to 6 $g/m^2$.

26. The printing paper of claim 20, intended for use in the CSWO or HSWO printing method, wherein the web treatment substance layer has a weight of 9 to 10 $g/m^2$.

27. The printing paper of claim 23, wherein the web treatment substance to be applied has a viscosity of not greater than 100 mPas.

28. The method of claim 12, wherein the web treatment substance to be applied has a viscosity of not greater than 100 mPas.

* * * * *